US010299534B2

(12) United States Patent
Gossman

(10) Patent No.: US 10,299,534 B2
(45) Date of Patent: May 28, 2019

(54) MIDFOOT ORTHOTIC SHOE INSERT

(71) Applicant: Laina Gossman, San Diego, CA (US)

(72) Inventor: Laina Gossman, San Diego, CA (US)

(73) Assignee: Laina Gossman, San Diego, CA (US)

( * ) Notice: Subject to any disclaimer, the term of this patent is extended or adjusted under 35 U.S.C. 154(b) by 112 days.

(21) Appl. No.: 15/369,782

(22) Filed: Dec. 5, 2016

(65) Prior Publication Data

US 2017/0164687 A1 Jun. 15, 2017

Related U.S. Application Data

(60) Provisional application No. 62/264,085, filed on Dec. 7, 2015.

(51) Int. Cl.

| | |
|---|---|
| ***A43B 7/14*** | (2006.01) |
| ***A43B 17/00*** | (2006.01) |
| ***A43B 17/02*** | (2006.01) |
| ***A43B 17/14*** | (2006.01) |

(52) U.S. Cl.

CPC ..... *A43B 7/149* (2013.01); *A43B 7/142* (2013.01); *A43B 17/003* (2013.01); *A43B 17/026* (2013.01); *A43B 17/14* (2013.01)

(58) Field of Classification Search

CPC ..... A43B 7/142; A43B 7/149; A43B 17/003; A43B 17/026; A43B 17/14; A43B 7/141; A43B 7/1415; A43B 7/143; A43B 7/1435; A43B 7/1445

USPC ..... 36/145, 153, 154, 166

See application file for complete search history.

(56) References Cited

U.S. PATENT DOCUMENTS

| | | | | |
|---|---|---|---|---|
| 2,447,954 | A * | 8/1948 | Meldman | A43B 7/143 36/181 |
| 5,282,326 | A * | 2/1994 | Schroer, Jr. | A43B 17/023 36/145 |
| D632,881 | S * | 2/2011 | Rosenberg | D2/961 |
| 2004/0194348 | A1* | 10/2004 | Campbell | A43B 7/142 36/93 |
| 2011/0126427 | A1* | 6/2011 | Richie, Jr. | A43B 7/1445 36/91 |
| 2013/0340281 | A1* | 12/2013 | Gossman | A43B 13/38 36/43 |

* cited by examiner

*Primary Examiner* — William V Gilbert

(74) *Attorney, Agent, or Firm* — Hard IP LLC

(57) ABSTRACT

The present invention relates generally to a device for supporting the foot and more particularly to a device for relieving pressure from specific areas of the foot, and for relaxing and shortening the musculatures of the foot by raising the arch. Through specific shapes and materials, the design intends to aid in alignment, add comfort, and prevent and relieve many foot problems and other lower extremity ailments. The device is uniquely designed to sit in the midfoot region of an article of footwear to relieve pressure from the heel and forefoot, redistribute pressure more evenly across the foot, and support the foot arches. The device may be constructed from flexible material which allows the orthotic to form to the shape of the shoe it is placed in. The medial wing portion of the orthotic device may utilize the medial wall of a shoe to increase arch support.

6 Claims, 5 Drawing Sheets

MIDFOOT ORTHOTIC SHOE INSERT

RELATED APPLICATIONS

The present application claims the benefit of U.S. Provisional Application Ser. No. 62/264,085, filed Dec. 7, 2015, which is expressly incorporated herein by reference in its entirety.

BACKGROUND

Feet are the foundation of the body. Without proper alignment of the joints of the feet, excessive stress and strain can occur in the feet as well as elsewhere in the body. The human foot may be subject to a variety of abnormalities that cause pain. Abnormalities and injuries of the foot may be caused by or made worse by footwear which does not properly support the foot.

Constructions devised to correct abnormalities, aid in alignment, add comfort, and prevent foot problems or injury occurring while wearing shoes are generally referred to in the art as "orthotics". Many orthotics are "full length" and intended to replace the existing insole within a shoe. It is also known in the prior art to provide orthotics comprising pads attached to the insole. These may take the form of metatarsal pads, midtarsal pads, arch pads or heel spur pads. These prior examples provide cushioning and some support, but not the same pressure offload, gait control and navicular support as the presently disclosed orthotic invention. These prior examples may provide a rigid support, while the present invention includes a prefabricated insole composed of flexible and soft material.

While there has been substantial investigation by prior art workers into orthotic devices, there has been little success designing functional orthotics for reducing injury or increasing comfort of slim-fitting shoes, high heeled shoes, shoes without removable insoles, and sandals.

Many women's and men's fashion shoes typically have a slim fit for greater fashion appeal. While the design of these shoes vary, it is generally common for these fashion shoes to leave no space for the conventional orthotic, and these shoes generally do not have a removable insole that can be replaced with a conventional orthotic.

Sandals are another example of footwear in which prior designs and conventional orthotics will not fit. These conventional and prior orthotic designs will crowd the sandal, visibly distract from the original appearance, and will not stay securely in place.

BRIEF SUMMARY OF THE INVENTION

The present disclosure provides a new approach to orthotic shoe inserts. The disclosed device is uniquely designed to sit in the midfoot region of an article of footwear to relieve pressure from the heel and forefoot, redistribute pressure more evenly across the foot, support the foot arches, improve comfort, correct abnormalities, and prevent foot problems or injury occurring while wearing shoes. This present invention is made from a flexible material and has a unique shape that does not crowd shoes, forms to the shape of any shoe and does not cause heel slip.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
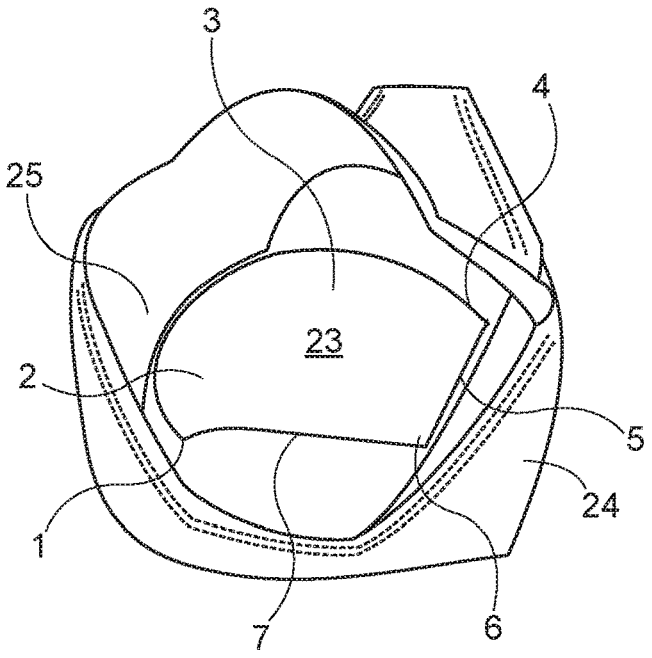
FIG. 1 is a photograph of the correct placement of the orthotic into a right shoe.
Figure 2:
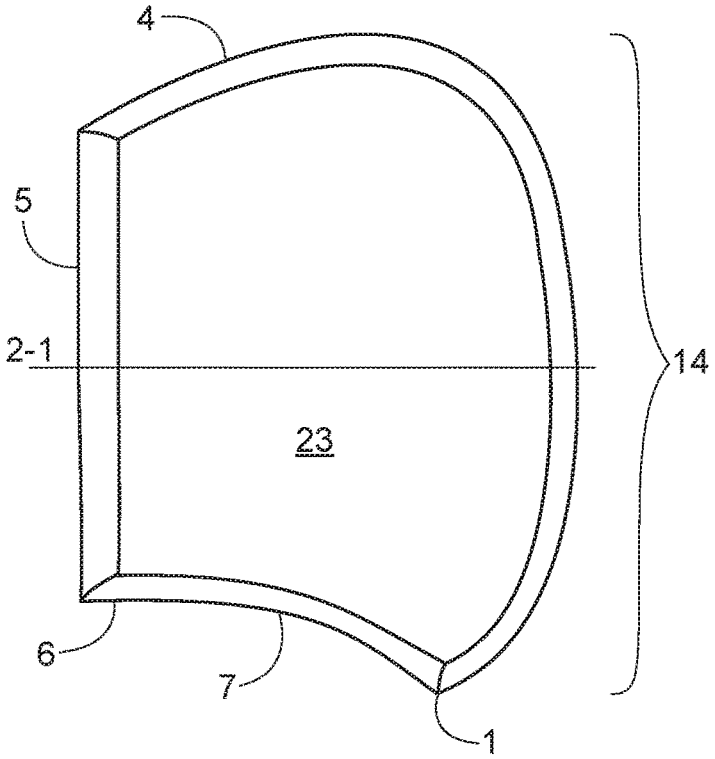
FIG. 2 is a top view of the left orthotic.

While the invention will hereinafter be described in connection with preferred embodiments and methods of use, it will be understood by those skilled in the art that it is not intended to limit the invention to these embodiments. On the contrary, it is intended to cover all alternatives, modifications, and equivalents, as may be included within the spirit and broad scope of the invention as defined only by the appended claims.

DETAILED DESCRIPTION OF THE PREFERRED EMBODIMENT

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The present disclosure provides a new approach to orthotic shoe inserts. The present disclosure provides novel structures and methods to improve comfort and beneficially support a user's foot structure, to correct abnormalities or problems which adversely affect the foot, and to prevent foot problems or injury occurring while wearing shoes.

Various examples of such orthotics include novel structures which provide benefits such as: transverse, lateral and medial arch support, impact absorption, redistribution of force and pressure, gait control, offload of pressure from metatarsal heads, offload of pressure from heel, prevention and healing of lower extremity injuries, and improved wearer comfort.

Examples of such orthotic devices may be used to realign the joints of the feet to their neutral, mid-range positions while wearing shoes. These devices may be used to maintain the structure and stability of the feet to help prevent subluxation of joints and strains of muscles, tendons, and ligaments of the feet and all joints up the kinetic chain of a person.

One example includes support structures are made of flexible material with a shape that extends from after the heel to before the forefoot and up the medial side of the foot. Orthotics according to the present disclosure are further advantageous as they occupy minimal space in footwear. Without detracting from the appearance of the footwear or causing the shoe to become crowded, orthotics according to the present disclosure may be used for reducing injury and enhancing the comfort of a wide variety of footwear including shoes with and without removable insoles.

A high-heeled dress shoe is one example of a shoe that the present orthotic device will help make more comfortable. A standard high-heeled dress shoe is designed so that the heel of the foot wearing the shoe is set higher than its toes. A number of painful foot problems result from this design. For example, the downward slant of the shoe forces the wearer's foot to slide forward, often jamming into the toe portion of the shoe. This can be very painful and it has been shown that at least 85% of all high-heeled shoe wearers experience such pain. Also, the downward slant of the shoe places stress on the foot, causing the heel bone or calcaneus to tilt downward, or plantarflex, thereby locking the first metatarsal phalangeal joint and preventing hallux extension or "toe lock". This causes the foot to pronate, which is uncomfortable for the foot, as well as it adversely affects the wearer's posture and ambulation. Therefore, wearers of high-heeled shoes often complain of problems associated with toe pain, arch pain. as well as general lower back problems. Orthotic devices according to the present disclosure are designed to combat this issue. These devices will not take up any space in the toe box area, while offloading pressure from the forefoot, they will add arch support and will often help prevent the foot from sliding forward without causing heel slip.

Referring to FIGS. 1 to 10, a preferred embodiment and examples of orthotic inserts according to the present invention are depicted. In one example, support structures are made of flexible material with a shape that extends from under the navicular 16 and after the calcaneus 17 to before the metatarsal heads 12 and up the medial side of the foot.

Included herein are examples of unique devices for foot comfort. In some examples, the shape is enhanced by the use of flexible rather than a stiff material. These orthotic designs enhance the comfort of a wide variety of footwear.

One exemplary orthotic insert depicted is adapted to be inserted into an article of footwear such that, in use, the orthotic example lies between the footwear and the underside of the person's foot so as to provide a degree of biomechanical support and control for the foot. It should be noted that corresponding structures and benefits may be realized in all lengths of orthotic inserts, such as full length inserts.

These orthotic designs increase arch support in any article of footwear that they are used with. In shoes that already have some support, use of these orthotic designs will give the wearer a larger amount of support. Also, these orthotic designs make a significant difference in the comfort of shoes that have little to no arch support.

Figure 10:
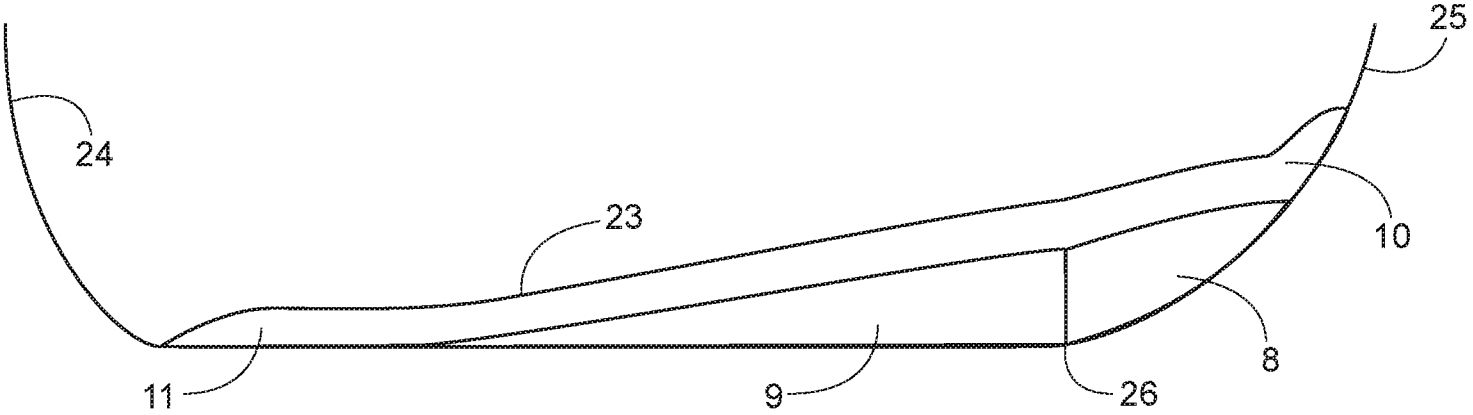
FIG. 10 is a frontal, cross-sectional view of the orthotic taken on the line 2-1 in FIG. 2; Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

As depicted in FIGS. 1 and 10, the medial wing 10 of the orthotic example extends up the medial side of the foot in a way that it rests on the medial wall 25 of the shoe that therefore aids in the support. This means that in a shoe with a more rigid medial wall 25, the wearer will experience increased support as compared to a shoe that has a soft or nonexistent medial wall 25.

These orthotic designs aim to prevent the navicular bone 16 from dropping too low, preventing over pronation, keeping the foot in alignment and therefore helping to prevent and heal injuries in the ankles, knees, hips and back while standing and moving around. These orthotic designs help the wearer to walk with a biomechanically correct gait. These designs also help prevent and relieve plantar fasciitis by supporting the arch and stopping the arch from collapsing. These orthotic designs thicken from medial to lateral in portion 8. Thinnest portion at the edge of 10 is between about 2 mm-4.5 mm up to the thickest portion 26 between about 6 mm-10 mm. These orthotic designs support the transverse, and medial arch in portion 9. They taper radially from thickest portion 26 to thin portion 11 between about 2 mm-4.5 mm. The medial wing 10 tapers from about 2 mm-4.5 mm at thickest point to zero at the medial edge. Portion 11 has thickness of about 2 mm-4.5 mm throughout and tapers at all edges to zero. Portion 11 helps to support the lateral arches of the foot.

Figure 3:
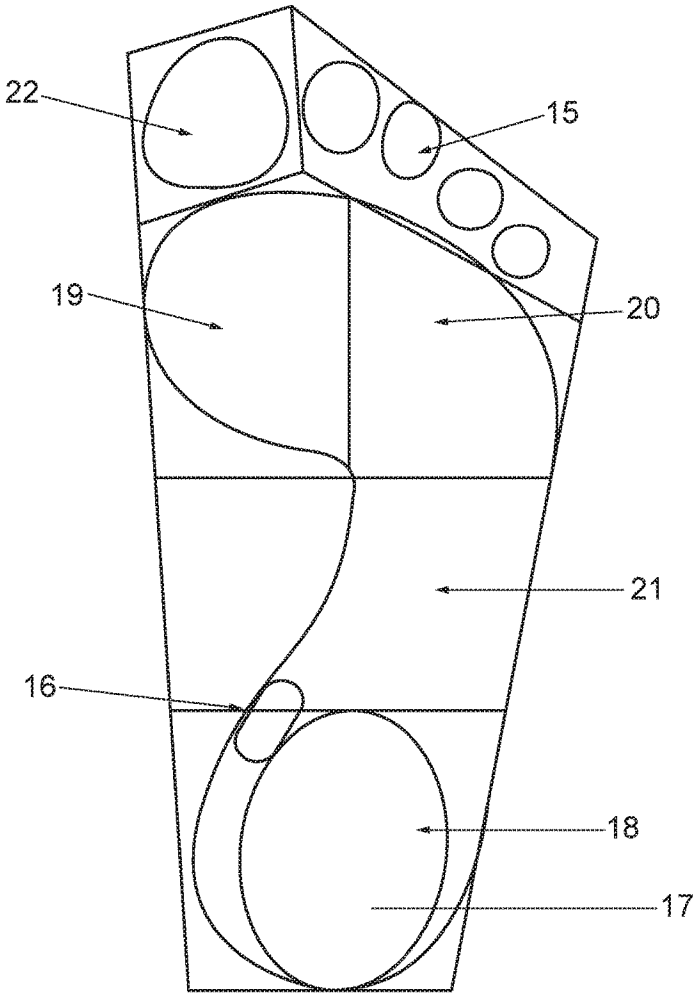
FIG. 3 is a drawing with segments depicting various plantar surface regions.
Figure 5:
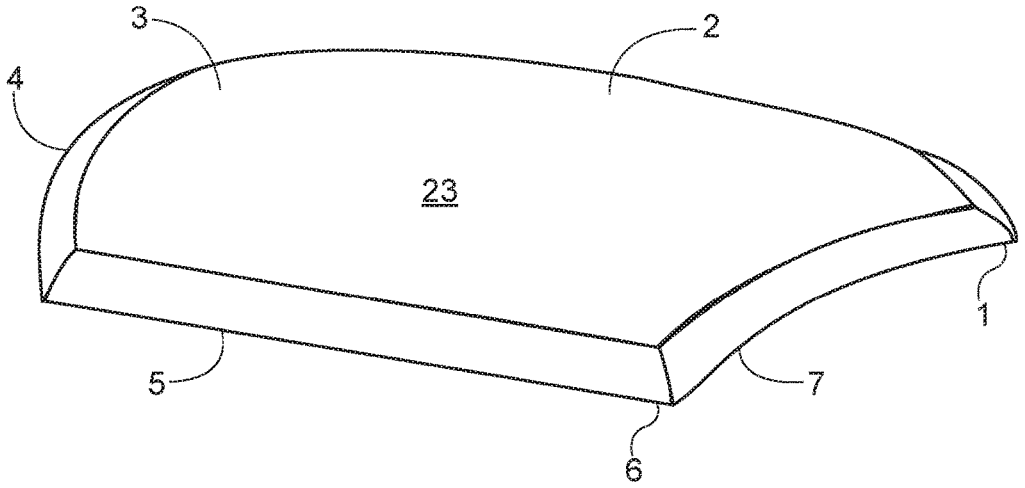
FIG. 5 is an isometric lateral view of the top side of a left orthotic.

FIG. 3 is a drawing with segments depicting various plantar surface regions. FIG. 3 depicts a hallux 22, toes 15, a medial forefoot 19, a lateral forefoot 20, a midfoot 21, a navicular bone 16, a heel 18, and a calcaneus bone 17.

Figure 4:
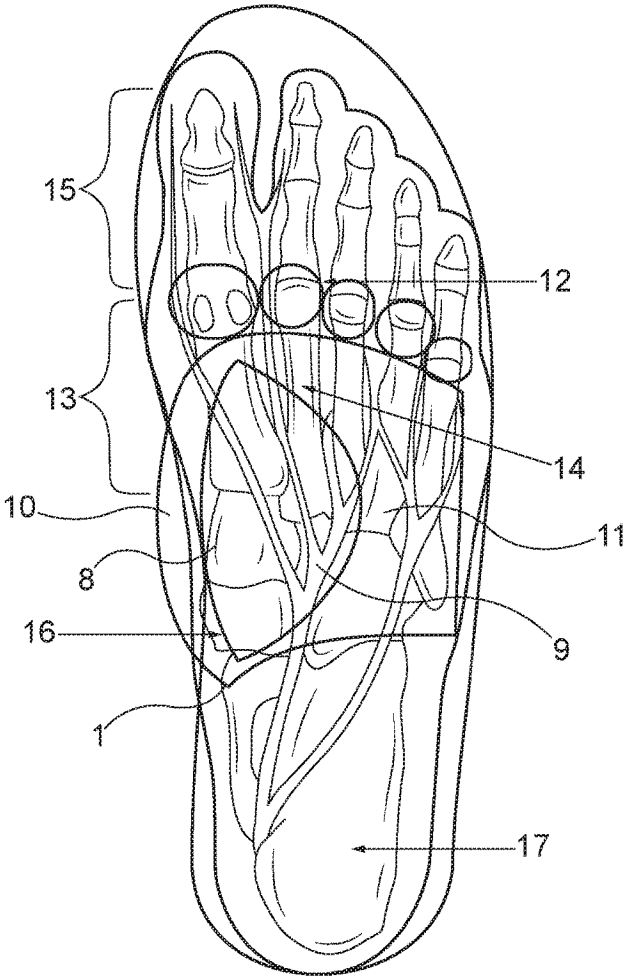
FIG. 4 is a bottom view of a left skeletal foot within the outline of a shoe footbed with correct placement of the orthotic.

FIG. 4 is a bottom view of a left skeletal foot within the outline of a shoe footbed with correct placement of the orthotic. FIG. 4 depicts toes 15, metatarsal heads 12, a midfoot orthotic 14, metatarsals 13, the navicular bone 16, the calcaneus bone 17, the medial wing 10, and portions 11, 8, and 9 (described above).

These orthotic designs will be prefabricated to set sizes. Larger sizes will be proportionally 200 thicker, longer and wider. Smaller sizes will be proportionally thinner width, shorter length and less thickness.

These preferred orthotic designs are composed of one or more materials that are flexible and configured to offer substantial support, energy return, impact absorption and maintains shape over time. For aesthetic and functional purposes, the use of a flexible material will allow the orthotic to fit into a wider variety of shoes as they will conform to the shoe that it is worn inside of, as shown in FIG. 1. Due to the flexibility of the material, the originally flat upper surface 23 can become convex upon adhesion to the shoe, as shown in FIG. 10. For these devices, soft, flexible material is chosen to gently guide the foot to the correct position and to allow necessary movement in the foot. Hard material rigidly forces the foot into position and it is not the preferred material.

One example includes these orthotic designs will allow for a dancer to point his/her toes and maintain that desirable curve in the arch area. These orthotic designs are lightweight enough to not change the perceived weight of shoes. They will also increase balance and posture. These disclosed devices are designed to increase performance of shoes for a variety of specialized activities. Athletes as well as people young and old alike can protect their feet without being impeded by a bulky orthotic.

One example provides a prefabricated orthotic insert that is composed of a polyurethane gel. Polyurethane gel, can be a flexible material having an adhesive property that allows the orthotic to stay securely in place yet can easily be moved from shoe to shoe. Polyurethane gel allows the orthotic to be washable and reusable. Polyurethane gel can additionally be cured through a manufacturing process to have a top layer that is smooth and non-adhesive, whilst having a bottom portion that is adhesive. Also, polyurethane gel can be a clear, transparent color which allows for the orthotic to be less visible in a sandal, creating better aesthetic appeal.

Figure 6:
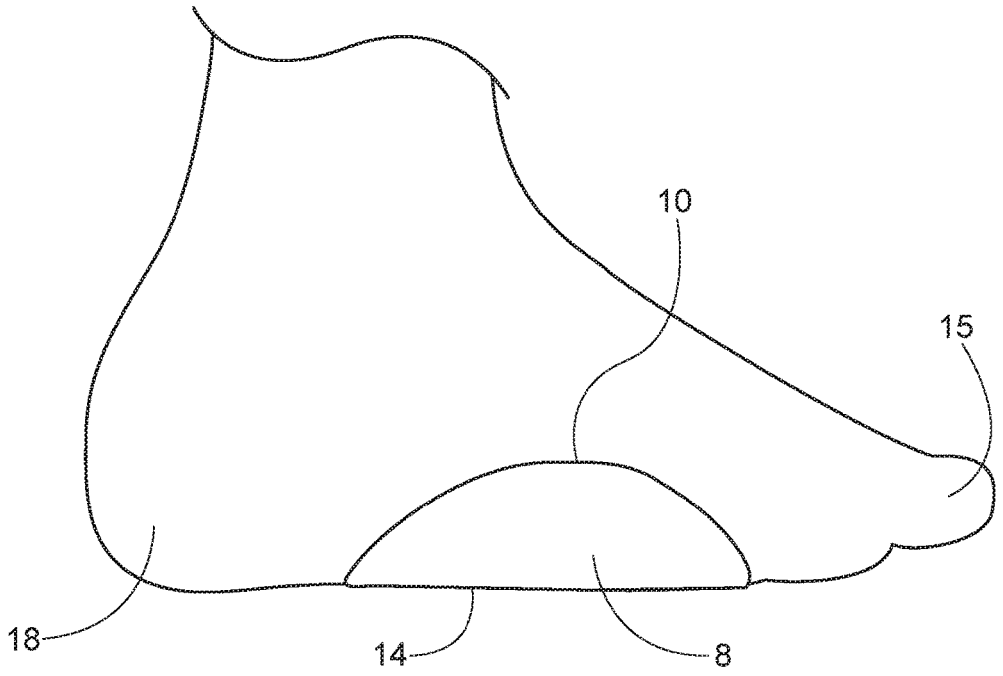
FIG. 6 is a medial view of a left foot with correct placement of the orthotic.
Figure 7:
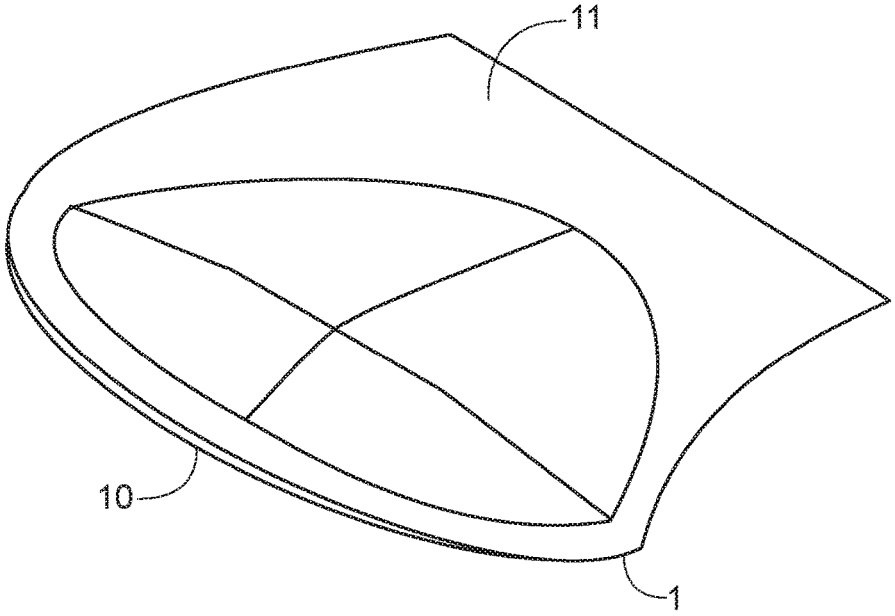
FIG. 7 is a bottom isometric view of the left orthotic.
Figure 8:
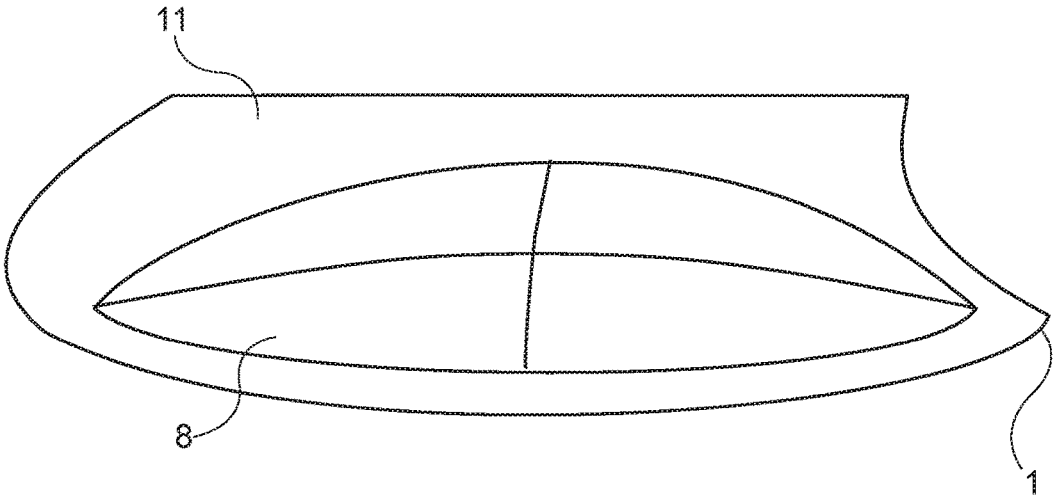
FIG. 8 is a bottom isometric view of the left orthotic from the medial side.
Figure 9:
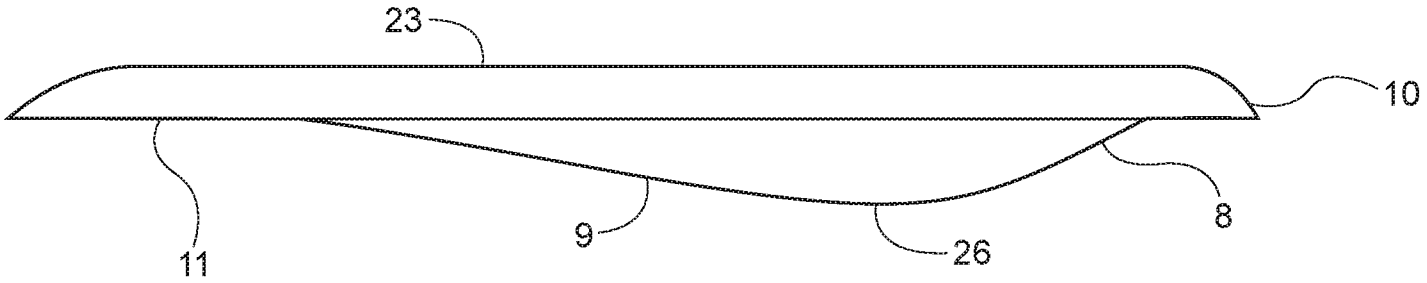
FIG. 9 is a frontal view of the right orthotic.

One example provides a prefabricated orthotic insert that the wearer's foot can rest in the correct biomechanical position whilst standing in a weight bearing position as depicted in FIG. 6. The orthotic as depicted in FIGS. 1-10 displays a shape that mainly covers the midfoot section of the foot and only extends to before the metatarsal heads 12 and under the navicular 16, but not under the calcaneus 17. This design is meant to offload pressure from the calcaneus 17 and metatarsal heads 12 and to distribute the weight more evenly across the entire foot. The shape of the orthotic creates a ramp that drops off 4 before the metatarsal heads 12 which may be used to offload pressure from the forefoot 19, 20 including metatarsal heads 12.

Other prior foot orthotic designs extend under the calcaneus 17, raising the wearer's heel 18 up in the shoe, often causing heel slip. These disclosed orthotic designs stop before the calcaneus 17 so as not to cause heel slip. Also, these disclosed orthotic designs extend up to but not under calcaneus 17, helping to offload pressure and reduce impact force to the calcaneus 17. Other prior devices which begin after the calcaneus 17 do not extend under the navicular bone 16. These examples of orthotic designs extend under the navicular bone 16 to stop the navicular bone 16 from dropping too low and to prevent over-pronation. Other prior orthotic designs have navicular support, but they do not extend up to the metatarsal heads 12. These preferred orthotic designs extend up to but not under the metatarsal heads 12 to offload pressure. These disclosed orthotic devices contrast with other prior orthotic designs that support the navicular arch 16 but they drop off without extending up the medial wall 25 of the shoe, providing less support to arch. In contrast with other prior designs, these orthotic designs extend up the medial wall 25 of the shoe to provide increased support to the arch.

In FIG. 10 it is shown that the flexible midfoot orthotic bends and forms to the article of footwear that it is placed into. These preferred orthotic designs are slim enough for use in any shoe without changing the fit. Dress shoes, high heels, flats, sandals, ballet shoes, soccer shoes, ski boots, snowboard boots, casual shoes, athletic shoes, cycling shoes, golf shoes, cowboy boots, dance shoes, skates, natural motion shoes, military boots and more will be made more comfortable by using these orthotic designs.

Although the invention has been described with reference to specific examples it will be appreciated by those skilled in the art that the invention may be embodied in many other forms.

I claim:

1. A preformed, flexible orthotic for disposition between a shoe and a foot of a user, the orthotic comprising:

a medial wing configured to be disposed beneath a navicular bone of a foot of a user, wherein the medial wing is configured to be disposed along a medial side of the foot, and wherein the medial wing comprises an endpoint configured to be disposed beneath a medial edge of the medial side of the foot;

wherein the orthotic defines a functional support structure which extends between a calcaneus of the foot and a metatarsal head area of the foot, wherein the functional support structure is configured to not extend under the calcaneus of the foot or under the metatarsal head area of the foot;

a medial portion of the medial wing of the orthotic, wherein in response to the orthotic being placed in between a shoe and the foot, the medial portion is configured to be disposed along a medial wall of the shoe, wherein the medial portion is configured to not extend past a top portion of a midfoot of the foot;

a lateral portion of the orthotic configured to be disposed along a lateral side of the foot, wherein the lateral portion is configured to not extend beyond the lateral side of the foot;

wherein the orthotic varies in width and tapers to 0 mm along all edges, wherein a greatest vertical thickness of the orthotic, ranging between 6 mm and 10 mm, is at a medial midpoint, wherein the orthotic radially tapers from the medial midpoint to a thinner vertical thickness of the orthotic, ranging between 2 mm and 4.5 mm, along an outer edge of the lateral portion of the orthotic, wherein the orthotic tapers from a first thickness level ranging between 2 mm and 4 mm to 0 mm between a top of the medial wing to the endpoint, and wherein a ratio of a maximum length to a maximum width of the orthotic is approximately 1 to 0.78.

2. The orthotic of claim 1, wherein the orthotic is formed from a flexible material selected from the group consisting of polyurethane, gel, foam, memory foam, urethane, ethylene-vinyl acetate, polyethylene, synthetic rubber, silicone, neoprene, and ethyl vinyl acetate.

3. The orthotic of claim 1, wherein the orthotic comprises a material configured to permanently or temporarily adhere thereto an inside of an article of footwear, or to a superior side or an inferior side of an insole.

4. The orthotic of claim 3, wherein the insole comprises a three-quarter length insole or a full-length insole.

5. The orthotic of claim 1, wherein the orthotic comprises a thin cover layer of material, the cover layer of material comprising at least one of leather, plastic, polyester, nylon, cotton, suede, canvas, elastic, rubber, vinyl, fabric, coronet, gel, neoprene, cork, bamboo fiber, silk, silicon, synthetic fabric, urethane, ethylene-vinyl acetate, polyurethane, polyethylene, or a synthetic rubber.

6. The orthotic of claim 1, wherein the orthotic is compatible with a plurality of shoe sizes.

* * * * *